US006572517B1

(12) United States Patent
Schimion

(10) Patent No.: US 6,572,517 B1
(45) **Date of Patent: *Jun. 3, 2003**

(54) CURRENT ROLLER FOR AN ELECTROLYTIC STRIP COATING PLANT

(75) Inventor: Werner Schimion, Hilchenbach (DE)

(73) Assignee: SMS Schloemann-Siemag Aktiengesellschaft, Düsseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 298 days.

(21) Appl. No.: 09/177,299

(22) Filed: Oct. 22, 1998

(30) Foreign Application Priority Data

Oct. 28, 1997 (DE) ..... 197 47 429
Feb. 4, 1998 (DE) ..... 198 04 257

(51) Int. Cl.[7] ..... B23P 15/00

(52) U.S. Cl. ..... 492/46; 165/89; 165/90

(58) Field of Search ..... 492/46, 43, 54, 492/58; 165/89, 90; 219/619; 399/330, 333; 191/1 A

(56) References Cited

U.S. PATENT DOCUMENTS

| | | | | | |
|---|---|---|---|---|---|
| 2,526,312 | A | | 10/1950 | Winterhalter | 191/1 |
| 4,631,792 | A | * | 12/1986 | Wesemann et al. | 492/46 |
| 4,683,627 | A | * | 8/1987 | Reinhold | 492/46 |
| 4,711,291 | A | * | 12/1987 | Reinhold | 492/46 |
| 4,888,464 | A | * | 12/1989 | Shibata et al. | 492/46 |
| 5,549,154 | A | * | 8/1996 | Niskamen et al. | 492/46 |
| 5,598,633 | A | * | 2/1997 | Hartz | 29/895.212 |
| 5,804,794 | A | * | 9/1998 | Matsuo et al. | 492/46 |
| 5,887,644 | A | * | 3/1999 | Akiyoshi et al. | 492/46 |
| 5,899,264 | A | * | 5/1999 | Marschke | 492/46 |
| 5,983,993 | A | * | 11/1999 | Watson et al. | 492/46 |
| 5,984,848 | A | * | 11/1999 | Hyllberg et al. | 492/46 |
| 6,105,651 | A | * | 8/2000 | Leanna | 156/555 |
| 6,158,501 | A | * | 12/2000 | Koivukunnas | 165/89 |
| 6,315,703 | B1 | * | 11/2001 | Quack et al. | 492/46 |
| 2001/0004933 | A1 | * | 6/2001 | Zaoralek | 165/90 |

* cited by examiner

*Primary Examiner*—I Cuda-Rosenbaum
(74) *Attorney, Agent, or Firm*—Friedrich Kueffner

(57) ABSTRACT

A current roller for an electrolytic strip coating plant includes a roller wall having an inner wall surface and an outer wall surface and two essentially cylindrical base bodies having cylindrical walls and filling out the roller wall, wherein the base bodies have sides facing each other and facing away from each other, wherein the roller wall and the base bodies are releasably connected to each other.

12 Claims, 3 Drawing Sheets

CURRENT ROLLER FOR AN ELECTROLYTIC STRIP COATING PLANT

BACKGROUND OF THE INVENTION

1. Field of the Invention

The present invention relates to a current roller for an electrolytic strip coating plant.

2. Description of the Related Art

A current roller generally has the purpose of returning the current transferred from coating anodes to a strip back to a rectifier. A distinction is made between current roller arrangements for horizontal and vertical strip travel.

In the case of horizontal coating systems, the strip to be coated is guided horizontally through a coating cell, wherein the current rollers are arranged in front of and behind the cell, rest from the top or bottom against the strip and apply a linear pressure to the strip by means of a rubber-coated counter-roller. When the circumferential speed of the roller corresponds to the strip speed, the current is transmitted from the strip to the current roller as a result of the linear contact between the strip and the current roller and the current is returned to the rectifier from the current roller by means of slip ring systems.

In vertical coating systems, the strip to be coated is deflected by 180° after emerging from the coating cell by means of current rollers which simultaneously serve as guide rollers, so that the strip can enter the next following coating cell. As a result of the contact surface between the strip and the current roller, the current flows from the strip to the current roller and from there through slip ring systems back to the rectifier. In this case, the current roller not only serves to transmit current, but also to guide the strip. Because of the bending stiffness of the strips, but also because of the relatively large distances between the coating cells, the current roller for vertical plants must be constructed with a relatively large diameter.

Because of the internal electrical resistance, the current roller is heated and its diameter increases accordingly. The strip surrounding the current roller is another heat source which is also heated as a result of the internal electrical resistance. In the case of strip thicknesses in the range of below 1 mm, the strip temperature may reach values of above 100° C. and the current roller is heated accordingly.

For these reasons, current rollers are usually provided with an internal cooling system which has the purpose of ensuring a uniform temperature distribution over the current roller length. The purpose of this is to ensure that sections having different temperatures do not result in different diameters over the length of the roller body. This would have the consequence that the strip guidance is no longer ensured and experience has shown that this also leads to a quality reduction of the coated surfaces.

Various embodiments of current roller cooling systems are known in the art.

In one embodiment, the current roller is essentially constructed as a round hollow body whose outer wall is of an acid-proof and current-conducting metal. The hollow body is filled partially or completely with cooling water, wherein cold water is introduced through one roller neck and heated water is discharged through the other roller neck. This solution is the least expensive, but has the following disadvantages:

The slow flow speed of the cooling water toward the inner wall surface means that the heat transfer is low when the roller is completely filled. In addition, the additional quantity of water increases the flywheel effect of the roller and, thus impairs the drive control. Also, a uniform temperature distribution over the roller body length cannot be ensured.

In accordance with another known solution, the hollow space is filled out substantially with displacement bodies, so that the latent water quantity in the interior of the current roller is reduced, however, the problem of the uncontrollable cooling effect remains.

The disadvantages described above are eliminated in accordance with another solution. In that case, tightly wound copper pipes are placed in a concentric gap between the outer current roller wall of high-grade steel and an inner cylinder of normal steel, wherein the cooling water flows with a high flow speed through the copper pipes. For effecting the heat transfer between the outer wall and the copper pipes, the remaining hollow space is filled by casting zinc metal into the hollow space.

This solution does ensure a controllable and uniform heat discharge, however, the manufacturing costs are significantly higher than in the solutions described previously. Another disadvantage is the fact that, after the roll wall has been ground repeatedly because of wear, the roller can only be repaired in a special shop, for example, by manufacturing a new wall and shrinking it onto the old wall which has previously been turned to size. A simple exchange of the used roller wall is not possible. Consequently, the operators of coating plants must have a large number of expensive current rollers in storage.

SUMMARY OF THE INVENTION

Therefore, it is the primary object of the present invention to provide a current roller which does not have the disadvantages discussed above, can be manufactured inexpensively and in an uncomplicated manner, and makes it unnecessary to keep complete rollers in storage.

In accordance with the present invention, a current roller having a roller axis for an electrolytical strip coating plant includes a roller wall having an inner wall surface and an outer wall surface and two essentially cylindrical base bodies having cylindrical walls and filling out the roller wall, wherein the base bodies have sides facing each other and facing away from each other, wherein the roller wall and the base bodies are releasably connected to each other.

As a result of the configuration according to the present invention, the roller wall can be easily exchanged, so that it is no longer necessary to keep entire current rollers in storage.

The current roller can be manufactured particularly inexpensively if the base bodies are made of normal steel and the roller wall of an acid-proof and electrically conductive material, such as high-grade steel.

If the cylinder walls of the base bodies are constructed so as to be electrically insulating, it is easier to control the current conduction in the roller wall. This makes it possible to ensure a uniform heating of the current roller. The cylinder walls can be electrically insulated, for example, by providing them with a hard, acid-proof, electrically insulating layer.

By providing on the inner wall surface of the roll wall an inner ring extending concentrically around the roller axis, the connectability between the roller wall and the base bodies can be effected especially simply. On the other hand, together with the electrical insulation of the cylinder walls, a completely symmetrical current conduction in the roller wall can be achieved.

The releasable fastening of the roller wall and the base bodies is particularly simple if the base bodies have through-bores which correspond to each other and extend parallel to the roller axis, wherein the throughbores receive fastening elements, for example, pull rods.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 4:
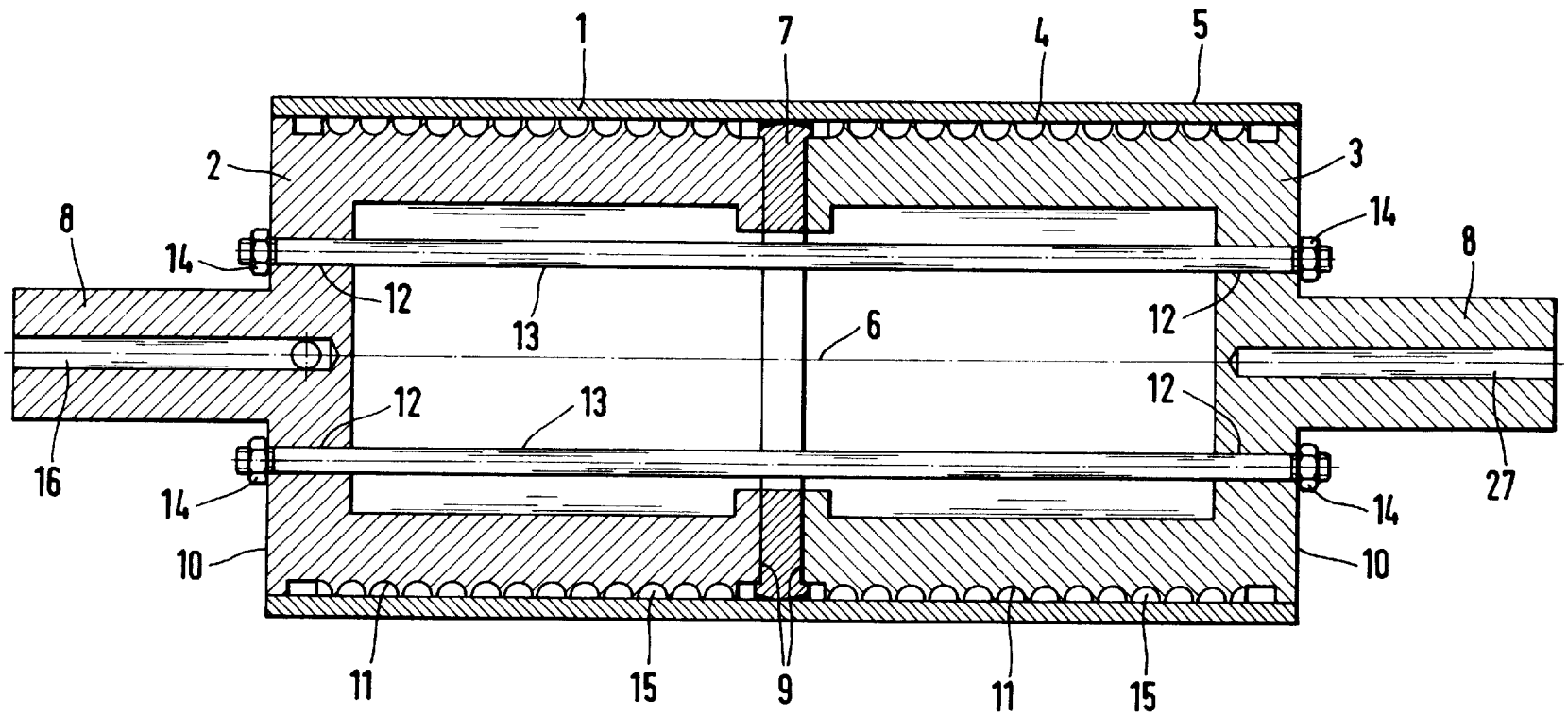
FIG. 4 is a sectional view of the current roller taken along sectional line B—B of FIG. 3.

As illustrated in the Figures of the drawing, a current roller for an electrolytical strip coating plant includes a roller wall 1 and two base bodies 2, 3. The roller wall 1 is essentially hollow cylindrically-shaped and has an inner wall surface 4 and an outer wall surface 5. The roller wall 1 is composed of an acid-proof, electrically conductive material, for example, high-grade steel. An inner ring 7 extending circumferentially around the roller axis 6 is welded to the inner wall surface 4 of the roller wall 1. As is apparent from FIGS. 2 and 4, the inner ring 7 is arranged in the middle of the roller.

The base bodies 2, 3 are essentially of equal construction. They are substantially cylindrical, are hollow and have at the sides facing away from each other pins 8 by means of which they are rotatably mounted in bearings, not shown. The base bodies 2, 3 are of normal steel. They substantially fill out the roller wall 1. In accordance with a preferred embodiment, the base bodies 2, 3 are received in the roller wall 1 with a precise fit. Consequently, the base bodies 2, 3 have sides 9 which face toward each other, sides 10 which face away from each other and cylinder wall surfaces 11 facing the roller wall 1.

The cylinder wall surfaces 11 are provided with a hard, acid-proof and electrically insulating layer. The layer may be composed, for example, of oxide ceramic material which contains fillers to prevent porosity. A coating of this type can be applied inexpensively and in a simple manner. The coating also protects the cylinder wall surfaces 11 against corrosion to a cooling liquid (water) and also against any electrolytic vapors. Thus, the cylinder wall surfaces 11 are constructed so as to be electrically insulating.

Because of the presence of the insulating layer between the base bodies 2, 3 and the roller wall 1, the entire current is forced to flow through the inner ring 7 and, consequently, symmetrically in the roller wall 1 from the outside toward the middle, and this independently as to whether the current is conducted further through one of the necks 8, the other of the necks 8 or both necks 8.

The roller wall 1 as well as the base bodies 2, 3 are arranged symmetrically relative to the axis 6 which will also be called roller wall axis hereinbelow.

The base bodies 2, 3 have throughbores 12. The through-bores 12 extend parallel to the roller axis 6 and correspond to each other. Pull rods 13 can be inserted into the through-bores 12, so that the roller wall 1 and the base bodies 2, 3 can be releasably connected to each other by means of threaded nuts 14 screwed onto the pull rods 13. As a result, the roller wall 1 can be easily exchanged when necessary without having to mechanically process the entire current roller. Consequently, the only part that has to be kept in storage is the roller wall 1.

Figure 1:
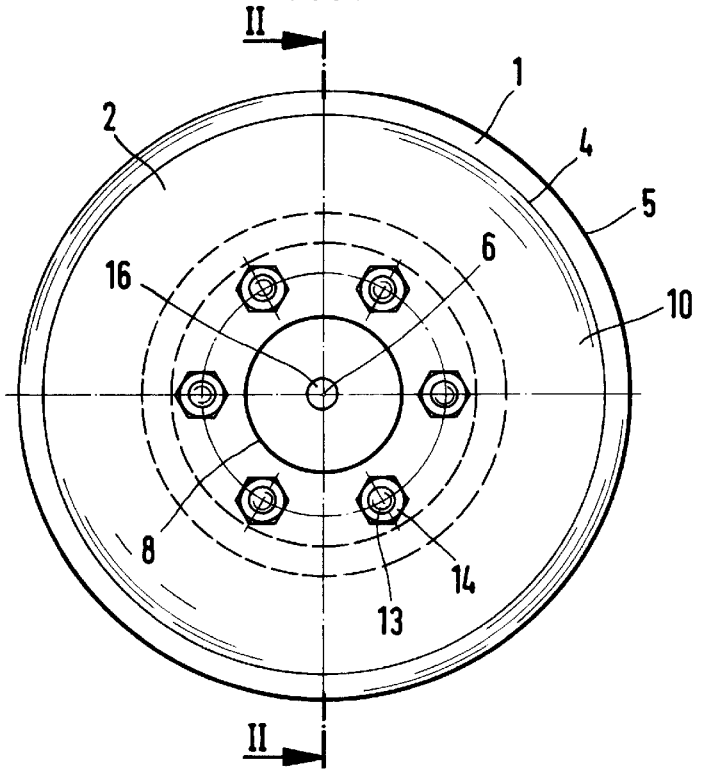
FIG. 1 is a side view of a current roller as seen in the direction of the roller axis.
Figure 3:
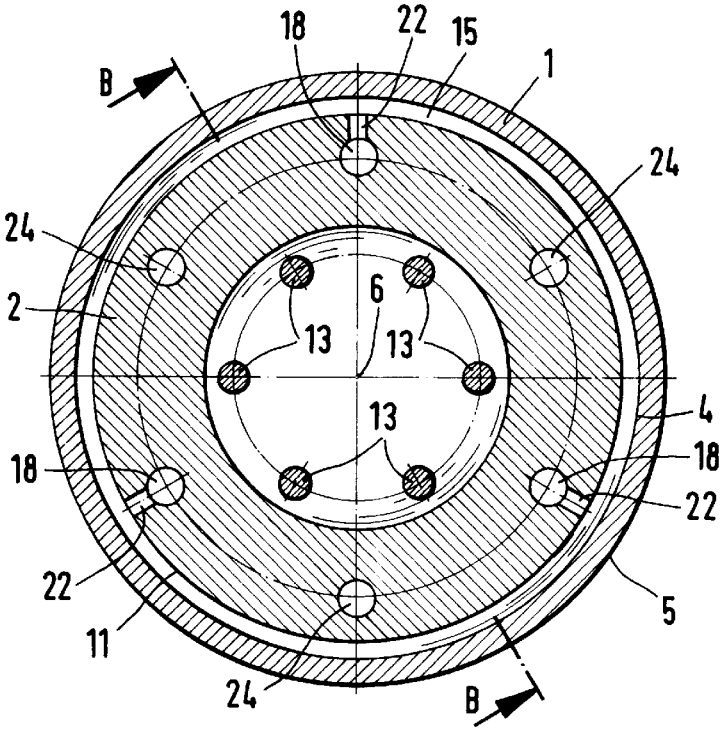
FIG. 3 is a sectional view of the current roller taken along sectional line A—A of FIG. 2.
Figure 2:
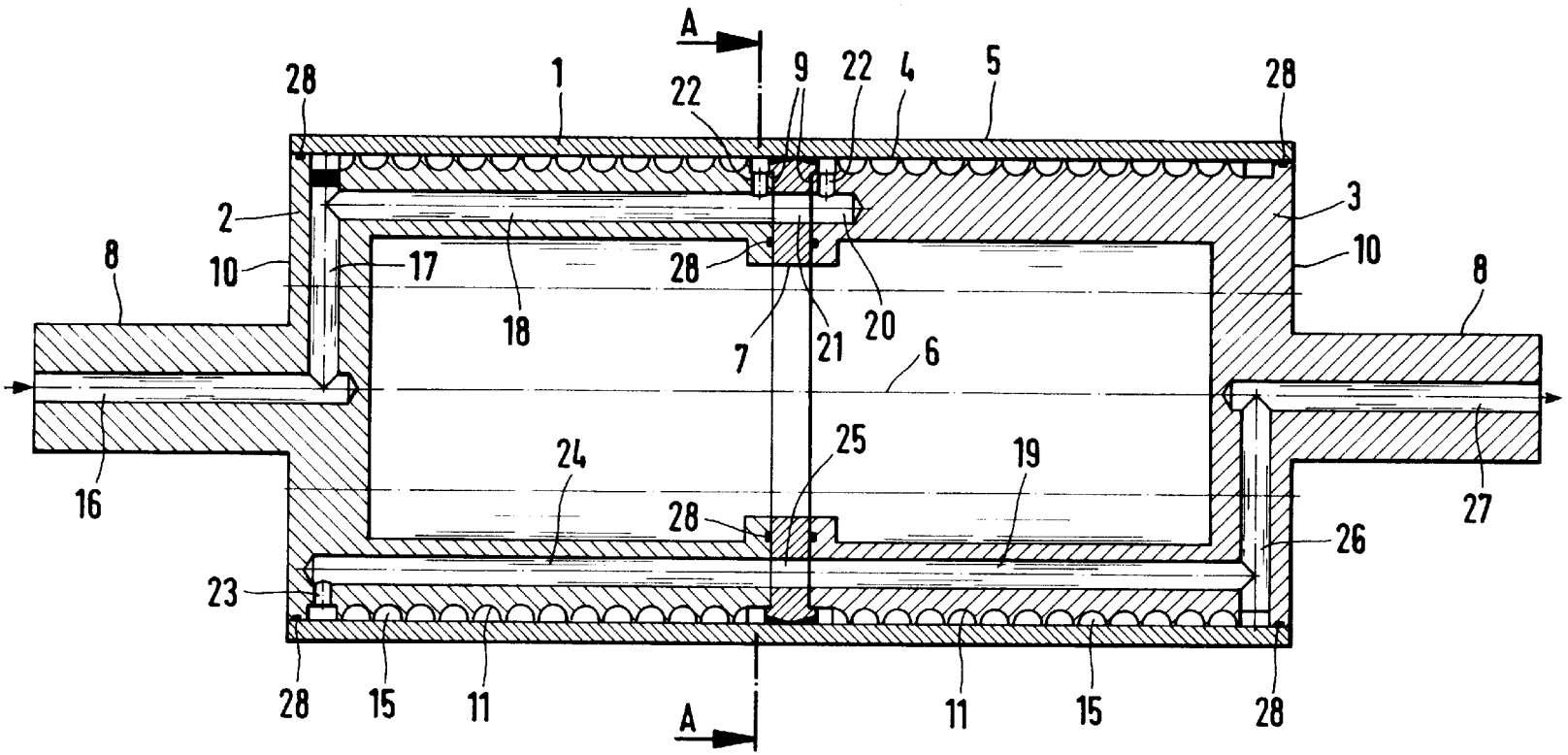
FIG. 2 is a sectional view of the current roller taken along sectional line II—II of FIG. 1.

The cylinder walls 11 of the base bodies 2, 3 have cooling ducts 15 for a cooling liquid, for example, water. The cooling ducts 15 are constructed as spirals extending around the cylinder walls 11. The cooling ducts 15 of one base body 2 are constructed left-handed, while the cooling ducts 15 of the other base body 3 are right-handed. In the illustrated embodiment, the cooling ducts 15 have a semi-circular cross-section. However, they may also have a different shape. The cooling liquid circulation is as follows:

The cooling liquid is fed into the current roller through a feed bore 16. The feed bore 16 of one base body 2 is located on the roller axis 6 and is arranged on the side 10 of the base body 2 facing away from the other base body 3. Through outer radial bores 17, FIG. 2 shows only one of the radial bores 17, the cooling liquid is fed into first longitudinal bores 18. The outer radial bores 17 are also arranged on the side 10 of the base body 2 facing away from the other base body 3. The first longitudinal bores 18 extend underneath the cooling ducts 15 parallel to the roller axis 2 and are open toward the inner ring 7. In addition, the outer radial bores 17 of the base body 2 are closed between the cooling ducts 15 and the first longitudinal bores 18, for example, by welding or by screwing in a threaded plug.

The other base body 3 also has first longitudinal bores 19 which will be discussed below. However, the other base body 3 additionally has second longitudinal bores 20 which are open toward the inner ring 7 and extend also parallel to the roller axis 6. The first longitudinal bores 18 of the base body 2 are connected to the second longitudinal bores 20 of the other base body 3 through throughbores 21 arranged in the inner ring 7. The base bodies 2, 3 additionally have inner radial bores 22 which are arranged on the sides 9 of the base bodies 2, 3 which face each other. The inner radial bores 22 connect the first longitudinal bores 18 of the base body 2 and the second longitudinal bores 20 of the other base body 3 to the cooling duct 15.

As a result of this configuration, the cooling liquid, for example, water, can be fed into the cooling ducts 15. The cooling liquid then flows helically from the inner ring 7 of the roller wall 1 toward the outer ends thereof.

For discharging the cooling liquid out of the cooling ducts 15, the base body 2 has on the side 10 facing away from the other base body 3 additional outer radial bores 23 which extend from the cooling ducts 15 to second longitudinal bores 24 of the base body 2. These second longitudinal bores 24 of the base body 2 also extend parallel to the roller axis 6. The second longitudinal bores 24 are open toward the inner ring 7 and extend up to a short distance in front of the side 10 of the base body 2 facing away from the other body 3. The second longitudinal bores 24 are connected through additional throughbores 25 arranged in the inner ring 7 to the already mentioned first longitudinal bores 19 of the other base body 3.

The first longitudinal bores 19 of the other base body 3 also extend underneath the cooling ducts 15 parallel to the roller axis 6 and are open toward the inner ring 7. The first longitudinal bores 19 are connected through outer radial bores 26 to the cooling ducts 15, on the one hand, and to a feed bore 27, on the other hand. As the name already indicates, the outer radial bores 26 of the other base body 3 are arranged on the side 10 of the other base body 3 facing away from the base body 2. The feed bore 27 is arranged in the other base body 3 and is located on the roller axis 6. From this feed opening 27 the cooling water can be discharged out of the current roller.

The cooling liquid circulation as described above has the result that fresh, cold cooling liquid is offered first to the central portion of the roller wall 1. Since, additionally, the strongest current flows in this wall portion and, consequently, this wall portion is heated most, the most intensive cooling takes place at the location of the greatest heating. This is the best way to maintain the cylindrical shape of the roller wall 1.

However, it is also possible to conduct the cooling liquid in the reverse direction. In that case, a camber of the current roller is achieved. This may be advantageous for the strip travel.

The necessary seals to prevent cooling liquid from leaking out and to prevent electrolyte from leaking in, conventional O-rings 28 are provided which can be easily replaced as necessary.

While specific embodiments of the invention have been shown and described in detail to illustrate the inventive principles, it will be understood that the invention may be embodied otherwise without departing from such principles.

I claim:

1. A current roller for an electrolytical strip coating plant, the current roller having a roller axis, the current roller comprising a roller wall having an inner wall surface and an outer wall surface and two essentially cylindrical base bodies received within the roller wall, the base bodies having cylinder walls and sides facing each other and sides facing away from each other, wherein the roller wall and the base bodies are releasably connected to each other so that the roller wall is exchangeable, the roller wall comprising an inner ring arranged on the inner wall surface and at a middle of the roller wall and extending concentrically relative to the roller wall axis, wherein the roller wall is of an acid-proof and electrically conductive material, wherein the cylinder walls of the base bodies have cooling ducts for a cooling liquid, wherein the cooling ducts extend spirally about the cylinder walls;

the base bodies have on the sides facing each other feed bores located on the roller axis for feeding in and out the cooling liquid;

the base bodies have at the sides facing away from each other each at least one radial bore connected to the respective feed bore;

the base bodies have underneath the cooling ducts each at least one first longitudinal bore connected to the outer radial bores, open toward the inner ring and extending parallel to the roller axis;

in a first of the base bodies the at least one outer radial bore is closed between the cooling ducts and the at least one first longitudinal bore;

the first base body has at the side facing a second of the base bodies at least one inner radial bore connected to the at least one first longitudinal bore;

the first base body has at least one second longitudinal bore open toward the inner ring and extending parallel to the roller axis, wherein the at least one second longitudinal bore extend to the side of the first base body facing away from the second base body and is connected through a first throughbore in the inner ring to the at least one first longitudinal bore of the second base body;

the first base body has on the side facing away from the second base body at least one additional outer radial bore which extends from the cooling ducts to the at least one second longitudinal bore;

the second base body has at least one second longitudinal bore open toward the inner ring and extending parallel to the roller axis, wherein the at least one second longitudinal bore is connected through a second throughbore in the inner ring to the at least one first longitudinal bore of the first base body; and the at least one second longitudinal bore of the second base body is connected to the cooling ducts through at least one inner radial bore arranged at the side of the second base body facing the first base body.

2. A current roller for an electrolytical strip coating plant, the current roller having a roller axis, the current roller comprising a roller wall having an inner wall surface and an outer wall surface and two essentially cylindrical base bodies received within the roller wall, the base bodies having cylinder walls and sides facing each other and sides facing away from each other, wherein the roller wall and the base bodies are releasably connected to each other so that the roller wall is exchangeable, the roller wall comprising an inner ring arranged on the inner wall surface and at a middle of the roller wall and extending concentrically relative to the roller wall axis, wherein the roller wall is of an acid-proof and electrically conductive material, wherein the cylinder walls of the base bodies are constructed so as to be electrically insulating.

3. The current roller according to claim 2, wherein the base bodies are of normal steel.

4. The current roller according to claim 2, wherein the material of the roller wall is high-grade steel.

5. The current roller according to claim 2, wherein the cylinder walls are provided with a hard, acid-proof, electrically insulating layer.

6. The current roller according to claim 2, wherein the base bodies are received in the roller wall with a precise fit.

7. The current roller according to claim 2, further comprising an inner ring extending concentrically around the roller axis arranged at the inner wall surface of the roller wall.

8. The current roller according to claim 7, wherein the inner ring is welded to the roller wall.

9. The current roller according to claim 7, wherein the base bodies have throughbores extending parallel to the roller axis and in alignment with each other, further comprising fastening elements extending through the throughbores.

10. The current roller according to claim 9, wherein the fastening elements are pull rods.

11. The current roller according to claim 2, wherein the cylinder walls of the base bodies have cooling ducts for a cooling liquid.

12. The current roller according to claim 2, wherein the base bodies substantially fill out the roller wall.

* * * * *